United States Patent [19]

Honda et al.

[11] Patent Number: 4,535,049

[45] Date of Patent: Aug. 13, 1985

[54] PRESSURE-FIXING TONER FOR ELECTROPHOTOGRAPHY AND PROCESS FOR PREPARATION THEREOF

[75] Inventors: Nobuyasu Honda, Tenri; Toshiro Yamakawa, Osaka; Toshimitsu Ikeda, Himeji, all of Japan

[73] Assignee: Mita Industrial Co., Ltd., Osaka, Japan

[21] Appl. No.: 519,594

[22] Filed: Aug. 2, 1983

[30] Foreign Application Priority Data

Aug. 4, 1982 [JP] Japan ..... 57-135134

[51] Int. Cl.[3] ..... G03G 9/08

[52] U.S. Cl. ..... 430/137; 430/106.6; 430/110; 524/275; 524/277; 524/556

[58] Field of Search ..... 430/110, 115, 137, 106.6; 524/275, 277, 556

[56] References Cited

U.S. PATENT DOCUMENTS 3,829,314 8/1972 Shelffo .
3,873,325 3/1975 Westdale .
4,262,077 4/1981 Ito .
4,391,893 7/1983 Hendricks ..... 430/137

FOREIGN PATENT DOCUMENTS 2909357 9/1979 Fed. Rep. of Germany ..... 430/110
57-158848 9/1982 Japan ..... 430/137
1006085 9/1965 United Kingdom ..... 430/110
2070029 9/1981 United Kingdom ..... 430/137

*Primary Examiner*—Roland E. Martin
*Attorney, Agent, or Firm*—Sherman & Shalloway

[57] ABSTRACT

Disclosed is a pressure-fixing toner for the electrophotography, which comprises electroscopic particles having an indeterminate shape and comprising as a pressure-fixing binder component a composite binder component comprising a wax component and a resin component composed mainly of a styrene-acrylic copolymer at a weight ratio of from 54/46 to 20/80, wherein the wax component is present in the form of spherical particles having a particle size smaller than 10 microns in a continuous phase of the resin component.

4 Claims, No Drawings

PRESSURE-FIXING TONER FOR ELECTROPHOTOGRAPHY AND PROCESS FOR PREPARATION THEREOF

BACKGROUND OF THE INVENTION (1) Field of the Invention

The present invention relates to a pressure-fixing toner for the electrophotography and a process for the preparation thereof. More particularly, the present invention relates to a pressure-fixing toner for the electrophotography, which has excellent pressure-fixing property and electroscopic property in combination, and also to a process for the preparation of this toner.

(2) Description of the Prior Art

As the conventional pressure-fixing toner, there has been widely used a toner comprising a soft fixing component such as a wax and a hard fixing component as a wax in combination as the fixing component. These soft and hard components differ greatly from each other in the softening or melting conditions and also in the properties in the molten state (for example, when a wax is molten, a liquid having a low viscosity is formed). Accordingly, the operation of kneading the soft and hard components is very difficult.

For this reason, a pressure-fixing toner comprising such soft and hard components is mainly prepared according to a spray granulation method or the like. For example, the specification of U.S. Pat. No. 4,016,099 teaches the preparation of a microencapsulated toner by using a hard component as the shell and a soft component as the core. Furthermore, Japanese Patent Application Laid-Open Specification No. 119928/79 discloses a multinuclear microencapsulated toner comprising a dispersion of a soft component of the emulsion particle size in a continuous phase of a hard component.

However, in a pressure-fixing toner prepared according to the above-mentioned spray granulation method, bad influences of the solvent left in toner particles cannot be neglected, and blocking of the toner particles is readily caused in a development apparatus. Furthermore, toner particles obtained according to the spray granulation method have a substantially spherical shape, and therefore, when the toner is used as an electrically insulating toner, the charge quantity of the toner particles is inevitably smaller than that of angular particles having an indeterminate shape, though no particular disadvantage arises when the toner is used as an electroconductive developer.

In view of the foregoing, it is necessary to prepare a pressure-fixing toner excellent in both the pressure-fixing property and the electroscopic property in the form of toner particles having an indeterminate shape through kneading, pulverization and classification.

SUMMARY OF THE INVENTION

It is therefore a primary object of the present invention to provide a pressure-fixing toner composed of particles having an indeterminate shape, which has excellent pressure-fixing property and electroscopic property in combination.

Another object of the present invention is to provide a pressure-fixing toner for the electrophotography, in which scattering or tailing of toner particles is controlled at the development of an electrostatic image, blocking of toner particles is prevented and the flowability is very excellent.

Still another object of the present invention is to provide a process for the preparation of pressure-fixing toners for the electrophotography, in which the operation of kneading toner components with a pigment and the like is greatly facilitated and toner particles homogeneous in the composition can be formed by the pulverizing operation.

In accordance with one fundamental aspect of the present invention, there is provided a pressure-fixing toner for the electrophotography, which comprises electroscopic particles having an indeterminate shape and comprising as a pressure-fixing binder component a composite binder component comprising a wax component and a resin component composed mainly of a styreneacrylic copolymer at a weight ratio of from 54/46 to 20/80, wherein the wax component is present in the form of spherical particles having a particle size smaller than 10 microns in a continuous phase of the resin component.

In accordance with another fundmanetal aspect of the present invention, there is provided a process for the preparation of pressure-fixing toners for the electrophotography, which comprises the step of cooling a solution obtained by hot-dissolving a wax component in an aromatic solvent to precipitate spherical particles of the wax component having a particle size smaller than 10 microns and copolymerizing a styrene type monomer with an acrylic monomer in the system containing the spherical particles of the wax component to form a composite binding comprising the wax component and the resin component composed mainly of the resulting styrene-acrylic copolymer at a weight ratio of from 54/46 to 20/80, in which the wax component is present in the form of spherical particles having a particle size smaller than 10 microns in a continuous phase of the resin component, and the step of kneading the composite binder, if necessary together with a pigment or the like, and cooling and pulverizing the kneaded composite binder to form particles having an indeterminate shape.

In accordance with still another aspect of the present invention, there is provided a process for the preparation of pressure-fixing toners for the electrophotography, which comprises the step of cooling a solution obtained by hot-dissolving a wax component in an aromatic solvent to precipitate spherical particles having a particle size smaller than 10 microns, uniformly mixing and dispersing the resulting emulsion of the wax component with a solution of a styrene-acrylic copolymer and removing the solvent under such conditions that re-dissolution of the particles of the wax component or growth of the particles of the wax component is not caused, to form a composite binder comprising the wax component and a resin component composed mainly of the styrene-acrylic polymer at a weight ratio of from 54/46 to 20/80, in which the wax component is present in the form of spherical particles having a particle size smaller than 10 microns in a continuous phase of the resin component, and the step of kneading the composite binder, if necessary together with a pigment or the like and cooling and pulverizing the kneaded composite binder to form particles having an indeterminate shape.

DETAILED DESCRIPTION OF THE INVENTION

From the viewpoint of the combination of the pressure-fixing property and electroscopic property, in the pressure-sensitive toner of the present invention, it is very important that the wax component (A) and the resin component (B) composed mainly of a styrene-acrylic copolymer should be contained at an (A)/(B) weight ratio of from 54/46 to 20/80, especially from 50/50 to 30/70.

It is considered that the pressure-fixing property of toner particles to paper depends ordinarily on the balance between the adhering property to paper and the slip property of the toner image. Of the above-mentioned two components, the resin component (B) has a relation to the adhering property to paper and the wax component (A) has influences on the slip property of the toner image. If the amount of the wax component (A) is too large and exceeds the above range, the adhering force of the toner is small and hence, the formed toner image is readily separated from the paper surface by bending or the like. If the amount of the resin component (B) is too large and exceeds the above range, the slip property of the formed toner image is poor and the friction with a material falling in contact with the surface of a copy is increased, and therefore, the toner image is peeled from the paper surface by friction. In the present invention, by using the wax component (A) and the resin component (B) at the above-mentioned weight ratio, it is made possible to obtain by pressure fixation a toner image which has a best balance between the adhering property to the paper surface and the slip property of the toner image and is very excellent in the fixing property.

The mixing ratio of the wax component (A) to the resin component (B) also has important influences on the electroscopic property of toner particles. More specifically, if the amount of the wax component (A) exceeds the above range specified in the present invention, a sufficiently high friction charge can hardly be obtained by the mutual friction among toner particles (one-component type toner) or firction of toner particles with magnetic carrier particles (two-component type toner), and reduction of the image density or fogging is readily caused. Moreover, if a composite binder component containing the wax component in an amount exceeding the above range is formed into particles having an indeterminate shape by kneading and pulverization, particles containing the wax component at too high a content are readily formed, and these particles have a charging tendency different from those of toner particles having a normal composition. Accordingly, scattering or tailing of the toner is readily caused.

In the above-mentioned multi-nuclear encapsulated toner disclosed in Japanese Patent Application Laid-Open Specification No. 119928/79, the wax component and the resin component are present at a weight ratio of from 95/5 to 55/45. The toner of the present invention is clearly distinguished from this known toner because the wax component and the resin component are present at a weight ratio of from 54/46 to 20/80 in the toner of the present invention.

From the viewpoints of the adaptability to the kneading operation, the pressure-fixing property, the flowability of the toner and the prevention of blocking, in the pressure-fixing toner of the present invention, it is important to use a composite binder in which the wax component is dispersed and fixed in the form of spherical particles having a particle size smaller than 10 microns, especially emulsion particles having a particle size of 0.1 to 5 microns, in a continuous phase of the resin component. More specifically, in the case where the wax component is not dispersed or fixed in the form of particles having the above-mentioned fine particle size in the resin component, at the kneading step for forming toner particles having an indeterminate shape, phase separation is readily caused between the wax component and the resin component and the operation adaptability is extremely degraded, Furthermore, toner particles formed from this composition tend to block in a development apparatus, and they are poor in the flowability and formation of white lines or falling of a mass of the toner particles on a copy is readily caused.

Recently, use of a binder obtained by graft-polymerizing styrene type and acrylic monomers to low-molecule-weight polyethylene or the like for a pressure-fixing toner has recently been proposed (see Japanese Patent Application Laid-Open Specification No. 154741/81). Since this graft copolymer is formed by carrying out graft copolymerization while dissolving low-molecular-weight polyethylene in hot xylene, it is considered that polyethylene and a styrene-acrylic polymer chain grafted thereto are homogeneously present in the molecular sizes.

In contrast, in the composite binder of the present invention, the wax component is present in the emulsion particle size and the resin component is independently present in the continuous phase surrounding the wax component. In the present invention, since the wax component is present as the dispersed phase of the emulsion particle size, a desirable slip property can be imparted to the surface of the toner image at the time of the pressure fixation.

In the present invention, natural waxes such as vegetable waxes, animal waxes, solid fats and mineral waxes, and higher fatty acids, derivatives thereof and low-molecular-weight olefin polymers may be used singly or in combination as the wax component.

Examples of waxes that are preferably used in the present invention are described below, though waxes that can be used in the present invention are not limited to these waxes.

Waxes in narrow sense:

Carnauba wax, cotton wax, candelilla wax, cane wax, bees wax, sperm wax, shellac wax, wool wax, etc.

Mineral and petroleum waxes:

Montan wax, paraffin wax, microcrystalline wax, etc.

Solid higher fatty acids having 6 to 22 carbon atoms:

Palmitic acid, stearic acid, hydroxystearic acid, behenic acid, etc.

Higher fatty acid amides having 6 to 22 carbon atoms (by the term "higher" used hereinafter is meant "having 6 to 22 carbon atoms"):

Oleic acid amide, stearic acid amide, palmitic acid amide, N-hydroxyethyl-hydroxystearoamide, N,N'-ethylene-bis-stearoamide, N,N'-ethylene-bis-ricinolamide, N,N'-ethylene-bis-hydroxystearylamide, etc.

Alkali metal, alkaline earth metal, zinc and aluminum salts of higher fatty acids:

Calcium stearate, aluminum stearate, magnesium stearate, calcium palmitate, etc.

Hydrazides of higher fatty acids:

Palmitic acid hydrazide, stearic acid hydrazide, etc.

p-Hydroxyanilides of higher fatty acids:

Myristyric acid p-hydroxyanilide, stearic acid p-hydroxyanilide, etc.

β-Diethylaminoethyl ester hydrochlorides of higher fatty acids:

β-Diethylaminoethyl laurate hydrochloride, β-diethylaminoethyl stearate hydrochloride, etc.

Higher fatty acid amide-formaldehyde condensates:

Stearic acid amide-formaldehyde condensate, palmitic acid amide-formaldehyde condensate, etc.

Petroluem residues:

Asphate, gilsonite, etc.

Rubbers:

Nitrile rubber, chlorinated rubber, etc.

Synthetic hydrocarbons:

Fisher-Tropsch wax, its derivatives, etc.

Fatty acid esters and glycerides:

Polyethylene glycol, sorbitol stearate, etc.

Halogenated hydrocarbons:

Chlorinated paraffin, chlorinated propylene, etc.

Hardened oils:

Hardened castor oil, hardened beef tallow oil, etc.

Olefin polymer waxes:

Polyethylene wax, polypropylene wax, ethylenepropylene copolymer wax, oxidized polyethylene wax, acid-modified polyethylene wax, acid-modified polypropylene wax, etc.

Among these waxes, olefin polymer waxes are preferably used for attaining the objects of the present invention, and an olefin polymer wax having a molecular weight of 500 to 10,000, especially 700 to 5,000, is advantageously used.

From the viewpoints of the adaptability to the pulverizing operation for the preparation of the toner, the pressure-fixing property and the electroscopic property, it is important that the resin component used in the present invention should be composed mainly of a styrene-acrylic copolymer. Namely, the styrene-acrylic copolymer has appropriate hardness and brittleness in combination, and if this copolymer is used as the resin component, particles having an indeterminate shape can easily be obtained by the pulverization method. Because of the presence of acrylic units, the adhering force to paper is improved, and since the copolymer has good electric characteristics, a large friction charge quantity can be obtained.

As the styrene type monomer (a) in this copolymer, there can be mentioned monomers represented by the following general formula:

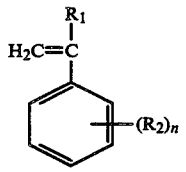

wherein $R_1$ stands for a hydrogen atom, a lower alkyl group (having up to 4 carbon atoms) or a halogen atom, $R_2$ stands for a substituent such as a lower alkyl group or a halogen atom, and n is an integer of up to 2 inclusive of zero, such as styrene, vinyl toluene, alpha-methylstyrene, alpha-chlorostyrene, vinyl xylene and vinyl naphthalene. Among these styrene type monomers, styrene and vinyl toluene are especially preferred.

As the acrylic monomer (b), there can be mentioned monomers represented by the following formula:

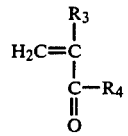

wherein $R_3$ stands for a hydrogen atom or a lower alkyl group, and $R_4$ stands for a hydroxyl group, an alkoxy group, a hydroxyalkoxy group, amino group or an aminoalkoxy group, such as acrylic acid, methacrylic acid, ethyl acrylate, methyl methacrylate, butyl acrylate, butyl methacrylate, 2-ethylhexyl acrylate, 2-ethylhexyl methacrylate, 3-hydroxypropyl acrylate, 2-hydroxyethyl methacrylate, 3-aminopropylacrylate, 3-N,N-diethylaminopropyl acrylate and acrylamide.

As another monomer to be used singly or in combination with the above-mentioned monomer (a) or (b), there can be mentioned, for example, conjugated diolefin monomers represented by the following formula:

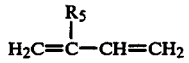

wherein $R_5$ stands for a hydrogen atom, a lower alkyl group or a chlorine atom, such as butadiene, isoprene and chloroprene.

As still another monomer, there can be mentioned ethylenically unsaturated carboxylic acids and esters thereof such as maleic anhydride, fumaric acid, crotonic acid and itaconic acid, vinyl esters such as vinyl acetate, and vinyl pyridine, vinyl pyrrolidone, vinyl ethers, acrylonitrile, vinyl chloride and vinylidene chloride.

It is preferred that the molecular weight of such vinyl type polymer be 3,000 to 300,000, especially 5,000 to 200,000.

In order to attain the objects of the present invention, it is preferred that in the above-mentioned copolymer, the styrene type monomer be present in an amount of 90 to 30% by weight, especially 80 to 50% by weight, and the acrylic monomer be present in an amount of 10 to 70% by weight, especially 20 to 50% by weight.

A small amount of other resin may be used in addition to the above-mentioned styrene-acrylic copolymer as the resin component. For example, there may be used natural resins such as balsam, rosin shellac and copal, vinyl resins such as a vinyl chloride-vinyl acetate copolymer resin, a vinylidene chloride resin, a vinyl acetate resin, a vinyl acetal resin, e.g., polyvinyl butyral, and a vinyl ether polymer, polyamide resins such as a polymerized fatty acid-modified polyamide, polyesters such as polyethylene terephthalate/isophthalate/adipate and polytetramethylene terephthalate/isophthalate/adipate, alkyd resins such as a phthalic acid resin and a maleic acid resin, phenol-formaldehyde resins, ketone resins, coumarone-indene resins, amino resins such as a urea-formaldehyde resin and a melamine-formaldehyde resin, and epoxy resins in combination with the above-mentioned styrene-acrylic copolymer. These auxiliary resins should be used in amounts of up to 40% by weight, especially up to 30% by weight, based on the total resins.

Additives for toners may optionally be incorporated into the composite binder of the present invention according to known recipes.

For example, at least one member selected from coloring pigments, extender pigments and magnetic pigments is used as the pigment. Of course, pigments having at least two of the above-mentioned functions can be used. For example, triiron tetroxide having a function as a magnetic pigment and a function as a black pigment, as seen from its another name "black iron", can be used in the present invention.

Suitable examples of the coloring pigment that can be used in the present invention are as follows:

Black Pigments:

Carbon black, acetylene black, lamp black and aniline black.

Yellow Pigments:

Chrome yellow, zinc yellow, cadmium yellow, yellow iron oxide, Mineral Fast Yellow, nickel titanium yellow, naples yellow, Naphthol Yellow S, Hansa Yellow G, Hansa Yellow 10G, Benzidine Yellow G, Benzidine Yellow GR, Quinoline Yellow Lake, Permanent Yellow NCG and Tartrazine Lake.

Orange Pigments:

Chrome orange, molybdenum orange, Permanent Orange GTR, Pyrazolone Orange, Vulcan Orange, Indanthrene Brilliant Orange RK, Benzidine Orange G, Indanthrene Brilliant Orange GK.

Red Pigments:

Red iron oxide, cadmium red, red lead, mercury sulfide, cadmium, Permanent Red 4R, Lithol Red, Pyrazolone Red, Watchung Red calcium salt, Lake Red D, Brilliant Carmine 6B, Eosine Lake, Rhodamine Lake B, Alizarine Lake and Brilliant Carmine 3B.

Violet Pigments:

Manganese violet, Fast Violet B and Methyl Violet Lake.

Blue Pigments:

Prussian blue, cobalt blue, Alkali Blue Lake, Victoria Blue Lake, Phthalocyanine Blue, metal-free Phthalocyanine Blue, partially chlorinated Phthalocyanine Blue, Fast Sky Blue and Indanthrene Blue BC.

Green Pigments:

Chrome green, chromium oxide, Pigment Green B, Malachite Green Lake and Fanal Yellow Green G.

White Pigments:

Zinc flower, titanium oxide, antimony white and zinc sulfide.

As the extender pigment that can be used in the present invention, there can be mentioned, for example, baryte powder, barium carbonate, clay, silica, white carbon, talc and alumina white.

As the dye, there can be used, for example, basic dyes, acidic dyes, disperse dyes and direct dyes such as Nigrosine, Methylene Blue, Rose Bengale, Quinoline Yellow and Ultramarine Blue.

As the magnetic pigment, there are known triiron tetroxide ($Fe_3O_4$), diiron trioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodium iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co) and nickel powder (Ni). Fine powders of these known magnetic substances can be used as the magnetic pigment singly or in combination. Magnetic pigments especially suitable for attaining the objects of the present invention are triiron tetroxide and $\gamma$-diiron trioxide.

The amount of the pigment can be changed in a relatively broad range according to the intended use of the developer, but in general, the pigment is incorporated in an amount of 1 to 500% by weight based on the binder. In case of a two-component type developer, namely when the toner is used as the toner to be combined with a magnetic carrier, it is preferred that a coloring pigment be used in an amount of 1 to 15% by weight, especially 2 to 10% by weight, based on the composite binder, and in case of a one-component type magnetic developer, it is preferred that a magnetic pigment be used in an amount of 50 to 500% by weight, preferably 100 to 400% by weight, based on the binder, if necessary, with a coloring pigment.

Known additives may be incorporated into the toner of the present invention according to known recipes. For example, a known charge controlling agent or dispersant, such as an oil-soluble dye, e.g., Nigrosine Base (CI 5045), Oil Black (CI 26150) or Spilon Black, a metal salt of naphthenic acid, a fatty acid metal soap, a resin acid soap or the like may be incorporated in an amount of 0.1 to 5% by weight based on the binder.

The preparation of the toner of the present invention will now be described. At first, the wax component (A) is dissolved in hot toluene maintained at a temperature higher than 65° C., especially at a temperature higher than 80° C. When the solution is cooled with stirring to room temperature or a lower temperature, the wax component is easily precipitated in the form of emulsion particles. Instead of toluene, an aromatic solvent such as xylene, ethylbenzene, cumene, benzene or a mixed solvent thereof may be used as the solvent for hot-dissolving the wax component.

The particle size of the precipitated emulsion particles can be adjusted by controlling the cooling speed, the concentration of the solution and the degree of stirring. In the present invention, it is preferred that the concentration of the wax component in the solution be 5 to 30% by weight, especially 10 to 20% by weight, and the cooling speed be 1° to 100° C./min, especially 3° to 50° C./min.

According to one preferred embodiment of the present invention, a styrene type monomer and an acrylic monomer are solution-polymerized in a dispersion of the emulsion particles. Of course, the weight ratios of the monomers used to the wax components should be within the above-mentioned ranges, and the polymerization conditions should be such that re-dissolution of emulsion particles of the wax component or growth of the particles is not caused.

In view of the foregoing, it is preferred that the solution polymerization be carried out at a temperature as low as possible in the presence of a radical polymerization catalyst. As the radical polymerization catalyst, there may be used peroxides such as benzoyl peroxide and dicumyl peroxide and azo compounds such as azobisisobutyronitrile. The polymerization catalyst can be used in an amount of 0.1 to 5% by weight based on the monomers. It is preferred that the solution polymerization be carried out in a homogeneous system, and if an aromatic solvent is used as the solvent, the polymerization is advanced in a homogeneous system and the composite binder is obtained in the form of a solution. The formed solution is poured into a non-solvent such as methanol and the composite binder is recovered as solids, and the recovered composite binder is dried under reduced pressure, if necessary after washing.

It will readily be understood that if other resin is dissolved in the emulsion of the wax component prior to the polymerization, this resin acts as a dispersion stabilizer to the emulsion particles.

The composite binder having the above-mentioned structure in which emulsion particles of the wax component are dispersed and fixed in a continuous phase of the resin component can be obtained according to the above-mentioned procedures.

In accordance with another embodiment of the present invention, an emulsion of the wax component and a solution of the styrene-acrylic copolymer resin are uniformly mixed and dispersed by using a highly shearing stirrer such as a homogenizing mixer, an ultrasonic vibration device or a sand mill. The solvent is removed from the resulting liquid mixture under such conditions that re-dissolution or growth of the particles of the wax component is not caused. Removal of the solvent can easily be accomplished by distillation under reduced pressure or throwing into a non-solvent.

The so-formed composite binder having the specific dispersion structure is kneaded with a pigment and the like, cooled, pulverized and, if necessary, classified to obtain toner particles having an indeterminate shape.

Since the composite binder according to the present invention has a specific structure in which the wax component is dispersed and fixed in a continuous phase of the resin component, the kneading operation can easily be accomplished by using a roll, a kneader or the like, and granulation by pulverization can easily be accomplished.

From the viewpoint of the quality of the formed toner image, it is preferred that the particle size of the particles having an indeterminate shape be 1 to 50 microns, especially 5 to 35 microns.

The present invention will now be described in detail with reference to the following Examples that by no means limit the scope of the invention.

EXAMPLE 1

40 parts by weight of a low-molecular-weight polyethylene wax (Mitsui Hi-Wax 200-P) and 360 parts by weight of toluene were heated at a temperature of 80° C., and immediately after the low-molecular-weight polyethylene was completely dissolved in toluene, the solution was cooled in a cold water bath with stirring. At a temperature lower than 65° C., the low-molecular-weight polyethylene was recrystallized and precipitated in the form of emulsion particles. The emulsion particles were spherical and had a size of about 1 micron. To the emulsion were added 40 parts by weight of monomeric styrene, 20 parts by weight of monomeric 2-ethylhexyl acrylate and 1 part by weight of azobisisobutyronitrile (AIBN), and after sufficient substitution of the atmosphere with nitrogen, the mixture was heated at 40° C. and 150 parts by weight of a 30% toluene solution of ethyl aluminum sesquichloride was dropped to the mixture from an injector with stirring. Since polymerization was advanced with generation of heat, the toluene solution was slowly dropped so that the reaction mixture was maintained at 40° C. After the lapse of 5 hours, the reaction mixture was thrown into 1500 parts by weight of methanol containing 75 parts by weight of 6M hydrochloric acid, and the solids were recovered by filtration, washed and dried. When 50 parts by weight of the obtained composite polymer was molten by a three-roll mill and observed by a microscope, it was found that the polyethylene wax was dispersed in the form of spherical particles having a particle size of about 1 micron. When 50 parts by weight of magnetite (BM-661 supplied by Toyo Shikiso) was dispersed in the composite polymer and the mixture was melt-kneaded by a three-roll mill, a lustrous mixture was obtained. The mixture was cooled and roughly pulverized into a size of about 2 mm by a rough pulverizer (Rotoplex cutting mill supplied by Alpine Co.). Then, the roughly pulverized product was finely pulverized by an ultrasonic jet mill (supplied by Nippon Pneumatic Mfg. Co. Ltd.) to obtain a toner having a size of 10 to 20 microns. When the toner was observed by a microscope, it was found that the magnetite was dispersed in a very good state. In order to improve the flowability of the obtained toner, 0.5% of silica (R-972 supplied by Nippon Aerosil) was sprinkled on the toner. When the copying operation was carried out on plain paper with the so-obtained toner in a copying machine of the pressure-fixing type (Model MC-20 supplied by Mita Industrial Co., Ltd.), a copy having a well-fixed toner image was obtained without scattering of the toner particles.

EXAMPLE 2

40 parts by weight of a low-molecular-weight polyethylene wax (Mitsui Hi-Wax 200-P) and 360 parts by weight of toluene were heated at 80° C., and immediately after the low-molecular-weight polyethylene was completely dissolved in toluene, the solution was colled in a cold water bath with stirring. At a temperature lower than 65° C., the low-molecular-weight polyethylene was recrystallized and precipitated in the form of emulsion particles. The recrystallized particles were spherical and had a particle size of about 1 micron. A solution of 60 parts by weight of a styrene-acrylic copolymer (Himer SBM-73 supplied by Sanyo Kasei) in 100 parts by weight of toluene was added to the so-formed emulsion and completely dispersed therein at room temperature by a homogenizing mixer. The dispersion was distilled under reduced pressure and the precipitate was dried.

Then, 50 parts by weight of the obtained composite polymer was molten by a three-roll mill and observed by a microscope. It was found that the polyethylene wax was dispersed in the form of spherical particles having a particle size of about 1 micron. Into the composite polymer was incorporated 50 parts by weight of magnetite (BM-661 supplied by Toyo Shikiso), and the mixture was melt-kneaded by a three-roll mill to obtain a kneaded mixture having a good luster. After cooling, the mixture was roughly pulverized into a size of about 2 mm by a rough pulverizer (Rotoplex cutting mill supplied by Alpine Co.) and finely pulverized by an ultrasonic jet mill (supplied by Nippon Pneumatic Mfg. Co. Ltd.) to obtain a toner having a size of 10 to 20 microns. When this toner was observed by a microscope, it was found that the dispersion state of the magnetite was very good. In order to improve the flowability of the toner, 0.5% of silica (R-972 supplied by Nippon Aerosil) was sprinkled on the toner. The copying operation was carried out on plain paper with this toner by using a copying machine of the pressure-fixing type (Model MC-20 supplied by Mita Industrial Co., Ltd.). A copy having a well-fixed toner image was obtained without scattering of the toner.

EXAMPLE 3

40 parts by weight of a low-molecular-weight polyethylene wax (Mitsui Hi-Wax 200-P) was dissolved in hot toluene maintained at 70° C. and 60 parts by weight of a styrene-acrylic copolymer (Himer SBM-73) was dissolved in toluene, and both the solutions were mixed and stirred by a homogenizing mixer at a temperature maintained at 70° C., and the mixture was distilled under reduced pressure and the precipitate was dried. Then, 50 parts of the obtained composite polymer was molten by a three-roll mill and observed by a microscope. It was found that the polyethylene wax was dispersed in the form of spherical particles having a size of about 1 micron. Then, 50 parts of magnetite (BM-661 supplied by Toyo Shikiso) was added to the composite polymer and the mixture was melt-kneaded by a three-roll mill to obtain a lustrous kneaded mixture. After cooling, the mixture was roughly pulverized into a size of about 2 mm by a rough pulverizer (Rotoplex cutting mill supplied by Alpine Co.) and finely pulverized by an ultrasonic jet mill (Nippon Pneumatic Mfg. Co. Ltd.) to obtain a toner having a size of 10 to 20 microns. When this toner was observed by a microscope, it was found that the dispersion state of the magnetite was very good. In order to improve the flowability of the toner, 0.5% of silica (R-972 supplied by Nippon Aerosil) was sprinkled on the toner, and the copying operation was carried out on plain toner with the so-obtained toner in a copying machine of the pressure-fixing type (Model MC-20 supplied by Mita Industrial Co., Ltd.). A copy having a well-fixed toner image was obtained without scattering of the toner.

EXAMPLE 4

An emulsion having precipitated particles was prepared from 40 parts by weight of an oxidized polyethylene wax (having an acid value of 19) and 360 parts by weight of toleuene in the same manner as described in Example 1. A solution of 60 parts by weight of a styrene-acrylic copolymer (Pliolite AC supplied by Goodyear) in 100 parts by weight of toluene was added to the emulsion, and the mixture was completely dispersed at room temperature by a homogenizing mixer. The dispersion was distilled under reduced pressure and the precipitate was dried. When 50 parts by weight of the obtained composite polymer was molten by a three-roll mill and observed by a microscope, it was found that the oxidized polyethylene was dispersed in the form of spherical particles having a particle size of about 1 micron. When magnetite was dispersed in the composite polymer in the same manner as described in Example 1, a lustrous toner having a size of 10 to 20 microns was obtained. The dispersion state of the magnetite was very good. The obtained toner was sprinkled with 0.5% of silica (R-972) and by using this toner, the copying operation was carried out on plain paper in a copying machine of the pressure-fixing type (Model MC-20 supplied by Mita Industrial Co., Ltd.) to obtain a copy having a well-fixed toner image without scattering of the toner.

EXAMPLE 5

An emulsion having precipitated particles was prepared from 40 parts by weight of a microcrystalline wax (#220 supplied by Mobil Oil) and 360 parts by weight of toluene in the same manner as described in Example 1, and 40 parts by weight of monomeric styrene, 30 parts by weight of monomeric methyl methacrylate and 1 part by weight of azobisisobutyronitrile were added to the emulsion and a composite polymer was obtained in the same manner as described in Example 1. When 50 parts by weight of the obtained composite polymer was molten by a three-roll mill and observed by a microscope, it was found that the microcrystalline wax was dispersed in the form of spherical particles having a particle size of about 1 micron. Magnetite (BM-661) was dispersed in the composite polymer in the same manner as described in Example 1 to obtain a lustrous kneaded mixture. The so-formed toner had a size of 10 to 20 microns and the dispersion state of the magnetite was very good. The obtained toner was sprinkled with 0.5% of silica (R-972) and by using this toner, the copying operation was carried out on plain paper in a copying machine of the pressure-fixing type (Model MC-20 supplied by Mita Industrial Co., Ltd.). A copy having a well-fixed toner image was obtained without scattering of the toner.

EXAMPLE 6

An emulsion having precipitated particles was prepared from 45 parts by weight of a low-molecular-weight polyethylene wax (San-Wax 161-P supplied by Sanyo Kasei) and 355 parts by weight of toluene in the same manner as described in Example 1, and 55 parts by weight of a styrene-acrylic copolymer (Pliolite AC) and 100 parts by weight of toluene were added to the emulsion and completely dispersed therein at room temperature by a homogenizing mixer. The dispersion was distilled and the precipitate was dried. When 90 parts by weight of the obtained composite polymer was molten by a three-roll mill and observed by a microscope, it was found that the low-molecular-weight polyethylene wax was dispersed in the form of spherical particles having a particle size of about 1 micron. Then, 7 parts by weight of carbon black (Special Black IV supplied by Degussa Co.) and 3 parts by weight of a charge controlling agent (Bontron S-31 supplied by Orient Kagaku) was dispersed in the composite polymer, and the mixture was dispersed and melt-kneaded by a three-roll mill to obtain a lustrous mixture. The obtained toner had a size of 10 to 20 microns, and the dispersion state of the carbon black and charge controlling agent was very good. A developer was prepared from 100 g of this toner and 900 g of an iron powder carrier (STV-25T supplied by Nippon Teppun), and by using this developer, the copying operation was carried out in a copying machine (Model DC-131 supplied by Mita Industrial Co., Ltd.; the fixing zone was replaced by a pressure-fixing apparatus). A clear copy having a well-fixed developer image and being free of fogging was obtained.

COMPARATIVE EXAMPLE 1

When 40 parts by weight of a low-molecular-weight polyethylene wax (Mitsui Hi-Wax 200-P) and 60 parts by weight of a styrene-acrylic copolymer were melt-kneaded by a three-roll mill, it was found that the adaptability to the kneading operation was very bad and the wax was separated from the copolymer resin. In this state, 100 parts by weight of magnetite (BM-661) was added and the mixture was dispersed and melt-kneaded by a three-roll mill, and a toner having a size of 10 to 20 microns was prepared from the mixture in the same manner as described in Example 1. It was found that the dispersion state of the magnetite was very bad and many particles of the polymer per se were formed. The toner was sprinkled with 0.5% of silica and by using this toner, the copying operation was carried out on plain paper in a copying machine of the pressure-fixing type (Model MC-20 supplied by Mita Industrial Co., Ltd.). The fixing property of the toner image was very bad, and fogging and scattering of the toner were conspicuous in the obtained copy. Moreover, the copy had a greyish tone.

COMPARATIVE EXAMPLE 2

When 45 parts by weight of a low-molecular-weight polyethylene wax (San-Wax 161-P) was melt-kneaded with 55 parts by weight of a styrene-acrylic copolymer (Pliolite AC), the adaptability to the kneading operation was bad and the wax was separated from the copolymer resin. In this state, 7 parts by weight of carbon black (Special Black IV) and 3 parts by weight of a charge controlling agent (Bontron S-31) were incorporated and dispersed, and the mixture was melt-kneaded by a three-roll mill and a toner having a size of 10 to 20 microns was formed in the same manner as described in Example 1. The dispersion state of the carbon black was very bad and many particles of the polymer per se were formed. A developer was prepared from 100 g of the so-obtained toner and 900 g of an iron powder carrier (STV-25T), and by using this developer, the copying operation was carried out in a copying machine (Model DC-131 supplied by Mita Industrial Co.; the fixing zone was replaced by a pressure-fixing device). In the obtained copy, the fixing property of the developer was very bad and fogging and scattering of the developer were conspicuous.

COMPARATIVE EXAMPLE 3

An emulsion having precipitated particles was prepared from 80 parts by weight of a low-molecular-weight polyethylene wax (Mitsui Hi-Wax 200-P) and 720 parts by weight of toluene in the same manner as described in Example 1, and 13 parts by weight of monomeric styrene, 7 parts by weight of monomeric methyl methacrylate and 1 part by weight of azobisisobutyronitrile were polymerized in this emulsion in the same manner as described in Example 1. Then, 50 parts by weight of the obtained composite polymer was molten by a three-roll mill and was observed by a microscope. It was found that the low-molecular-weight polyethylene wax was dispersed in the form of spherical particles having a size of about 1 micron. In the same manner as described in Example 1, magnetite (BM-661) was dispersed in this composite polymer to obtain a lustrous kneaded mixture. The dispersion state of the magnetite in the so-formed toner having a size of 10 to 20 microns was very good. The toner was sprinkled with 0.5% of silica (R-972), and by using this toner, the copying operation was carried out on plain paper in a copying machine of the pressure-fixing type (Model MC-20 supplied by Mita Industrial Co., Ltd.). The fixing property of the toner was very bad, and when the obtained copy was folded, the toner was peeled from the transfer paper along the folding line.

We claim:

1. A process for the preparation of pressure-fixing toners for the electrophotography, which comprises the step of cooling a solution obtained by hot-dissolving a wax component in an aromatic solvent to precipitate spherical particles of the wax component having a particle size smaller than 10 microns and copolymerizing a styrene type monomer with an acrylic monomer in the system containing the spherical particles of the wax component to form a composite binder comprising the wax component and the resin component composed mainly of the resulting styrene-acrylic copolymer at a weight ratio of from 54/46 to 20/80, in which the wax component is present in the form of spherical particles having a particle size smaller than 10 microns in a continuous phase of the resin component, and the step of kneading the composite binder with a pigment, and cooling and pulverizing the kneaded composite binder and pigment to form particles having an indeterminate shape.

2. The process of claim 1 wherein said pigment is selected from the group consisting of coloring pigments, extender pigments, magnetic pigments and mixtures thereof.

3. The process of claim 1 wherein said pigment comprises a coloring pigment selected from the group consisting of black pigments, yellow pigments, orange pigments, red pigments, violet pigments, blue pigments and green pigments.

4. The process of claim 1 wherein said pigment comprises carbon black.

* * * * *